US005554816A

United States Patent [19]

Skaggs et al.

[11] Patent Number: 5,554,816

[45] Date of Patent: Sep. 10, 1996

[54] REACTIVE BALLISTIC PROTECTION DEVICES

[76] Inventors: Samuel R. Skaggs, Rte. 11, Box 81E, Santa Fe, N.M. 87501; Mark F. Folsom, 25747 Carmel Knolls Dr., Carmel, Calif. 92923

[21] Appl. No.: 242,613

[22] Filed: May 13, 1994

[51] Int. Cl.[6] ..... F41H 5/007; F41H 5/08; F41H 5/04

[52] U.S. Cl. ..... 89/36.17; 42/1.08; 42/1.09; 109/49.5; 89/36.05; 89/36.02

[58] Field of Search ..... 89/36.05, 36.02, 89/36.17, 36.01; 42/1.09, 1.08; 109/49.5, 36, 37; 24/67.11, 67.5; 362/457

[56] References Cited

U.S. PATENT DOCUMENTS

| | | | |
|---|---|---|---|
| 469,971 | 3/1892 | Martin | 109/37 |
| 1,449,739 | 3/1923 | Dunnington | 109/37 |
| 2,012,453 | 8/1935 | Lowy et al. | 89/36.17 |
| 2,029,425 | 2/1936 | Kaylor et al. | 24/67.3 |
| 2,861,021 | 11/1958 | Dietz et al. | 89/36.02 |
| 2,955,194 | 10/1960 | Clyne | 24/67.5 |
| 3,648,613 | 3/1972 | Cunn . | |
| 3,745,938 | 7/1973 | Hathaway et al. | 109/49.5 |
| 3,762,345 | 10/1973 | Sgariglia, Jr. | 109/49.5 |
| 3,766,865 | 10/1973 | Cutler | 109/49.5 |
| 3,848,547 | 11/1974 | Schaefer | 109/49.5 |
| 3,859,399 | 1/1975 | Bailey et al. | 264/29 |
| 3,893,368 | 7/1975 | Wales, Jr. | 89/36.17 |
| 4,016,666 | 4/1977 | Finn et al. | 89/36.05 |
| 4,153,927 | 5/1979 | Owens | 362/457 |
| 4,442,780 | 4/1984 | Child | 109/29 |
| 4,546,863 | 10/1985 | Kaufman | 89/36.05 |
| 4,752,970 | 6/1988 | Arakaki | 89/36.17 |
| 4,869,152 | 9/1989 | Marlow et al. | 89/36.17 |
| 4,901,622 | 2/1990 | Perry | 89/36.02 |
| 4,919,037 | 4/1990 | Mitchell | 89/36.05 |
| 5,070,764 | 12/1991 | Shevach et al. | 89/36.17 |

FOREIGN PATENT DOCUMENTS

| | | | |
|---|---|---|---|
| 2081852 | 2/1982 | United Kingdom | 89/36.05 |

*Primary Examiner*—Stephen M. Johnson
*Attorney, Agent, or Firm*—LaRiviere, Grubman & Payne

[57] ABSTRACT

Reactive armor device for shielding a user from bullets or other ballistic threat combined with incapacitating device for disabling an assailant. A device constructed according to the principles of the present invention combines a modern technology armor element which shields a user from attack, and a reactive incapacitating element which renders the assailant at least temporarily incapable of continuing the attack. Armors used by the present invention include at least one of: technical ceramics, metals and metallic alloys, cermets, polymers, elastomers, high strength glass, and resins. The incapacitating element comprises at least one of: a brilliant flash device; reactive splashback and chemical spray. A device as taught by the present invention may be implemented in a wide variety of commonly available articles, or may be installed in furniture or structural panels.

14 Claims, 6 Drawing Sheets

REACTIVE BALLISTIC PROTECTION DEVICES

TECHNICAL FIELD

The present invention relates generally to armor devices for protection against armed assault. More specifically, the present invention teaches a reactive armor device which not only deflects an assailant's first bullet, but reactively renders the assailant incapable, at least temporarily, of further attack.

BACKGROUND ART

Recent social trends have led to an increase in injury and death from gunshot, to the point where, in some locales, the death rate from gunshot now exceeds that from automobile accidents. Persons exposed to risk from gunshot seek to protect themselves from such risk through a variety of methodologies. Many persons in high risk occupations such as law enforcement, security guards, bank tellers, couriers and the like seek to provide themselves with protection from gunshot by armed counterattack, or by using body armor or "bullet-proof" vests.

Armed counterattack to provide personal protection is not a satisfactory defense for several reasons. First, in order to be effective, self-defense using a firearm must be preemptive. This is seldom feasible. Secondly, guns in the hands of persons imperfectly prepared to use them are often the weapons used to victimize such persons. Finally, a person who fires a weapon in a populated area must do so with the knowledge that this can lead to unacceptable consequences to innocent bystanders.

The advantages of armor and other personal protective devices over counterattack are many and compelling. Effective use of personal armor does not require killing or maiming anyone, especially those persons who are not clearly threatening. Armor and other disabling devices can also can make the option of refraining from preemptive use of firearms a more viable tactic: if you can survive being fired upon, you can wait to be fired on before firing your own weapon. Non-lethal disabling methods, such as flash and incapacitating spray can be used more readily and more responsibly than firearms can, since the defensive user does not have to weigh the possibility of killing or maiming innocents. These non-lethal methods also present the psychological advantage of protecting the user while avoiding killing someone in self-defense. Armor and other protective devices pose little danger to the user's surroundings and bystanders. The materials which form modern armors are well consolidated, are typically unaffected by solvents, and pose no environmental hazard.

Body armor is, however, not a complete solution to the risk of gunshot in that it leaves one of the most vulnerable parts of the body, i.e. the head, exposed. What is needed therefore, to improve a user's survivability, is a rapidly deployable shielding device to temporarily cover those portions of the body, like the head, which are not covered by body armor. A solution applied by several workers to this problem rests in the fact that many persons, for instance police officers, often carry or have about them clipboards or similar devices. Such a clipboard, when composed of a suitably projectile-resistant material, can provide a rapidly deployable shield for the head or other unarmored portions of the body. Efforts by others have yielded several versions of an "armored clipboard" to provide the previously discussed shielding device.

The previous attempts by others to utilize a clipboard or other small, commonly available article as a shielding device all exhibit shortcomings. The most common problem which prior art attempts fail to address is that an assailant's first bullet may be deflected or stopped by the device, but the bullet will probably knock the device from the user's hand or move it sufficiently aside that a quickly fired second shot may leave the user unprotected in the head area. Given that almost all firearms in current production are capable of fairly rapid fire, this is a serious limitation of the prior art.

A second shortcoming of many ballistic clipboards is that they are prone to losing much of their resistance to penetration over time. U.S. Pat. No. 3,848,547 to Schafer discloses one such invention. The clipboard, as taught by Schafer, is typically formed of a polycarbonate material conforming to ASTM D-6300 standards. A shortcoming of polycarbonates is that within a fairly short span of time, up to 50% of their ballistic resistance may be lost or degraded due to internal changes in the material itself. This degradation in ballistic performance is often exacerbated with exposure to ultraviolet radiation or to a wide range of solvents.

Modern material science has produced several materials which are very effective at stopping bullets and other ballistic objects. Some are used in the previously discussed bullet-proof vests, and for other military applications. Many of these new armor materials serve to break up a projectile and catch its fragments, thereby preventing injury to the user. One example of these high strength armors is described in U.S. Pat. No. 3,859,399.

Another advance in armor technology is the development of reactive armors. A reactive armor is one which performs some act or undergoes some change in response to a threat. U.S. Pat. No. 4,869,152 describes a typical reactive armor. Most reactive armors combine an advanced armor system with an explosive element which is fired in response to a projectile striking or approaching the surface of the armor. The outward blast of the explosive element of the reactive armor tends to blunt the intensity of the projectile's velocity, rendering it less capable of penetrating an armor sub-layer, or of deflecting the projectile so that it strikes the armor substrate at an oblique angle, again reducing the projectile's armor-piercing capacities. Other reactive armors are described in U.S. Pat. Nos. 4,901,622 and 5,070,764.

Explosive reactive armors are generally not well suited for use in personal armor devices. While effective in some military applications, for instance mounted on the glacis of a tank, the potential for unwanted detonation while being carried by an individual makes them less than optimal for personal use. Having an explosive component, explosive reactive armors also introduce an unwanted element of lethality into a personal protective device. A reactive element, however, which would serve to incapacitate an assailant, if coupled with a modern armor material, would provide a significant advantage over the prior art. Specifically, such a device would provide both the required protection against the assailant's first shot and preclude or degrade his ability to deliver an accurate second shot.

In order to stop a bullet, many modern technical armor materials perform two functions. The first is to break the bullet into small fragments in order to reduce its penetrating ability. To break up a bullet requires a material that is at least as hard as the bullet itself. To this end many armors include materials like hardened steel, titanium alloys or ceramics as the first surface the bullet impacts. During the process of bullet breakup a significant portion of the fragments broken up by the hard material continues to move in substantially the same direction as the bullet's original trajectory. If any of these fragments succeed in piercing the hardened material, it is imperative that they be contained before they traverse completely through the armor and render injury to the person the armor is supposed to protect. The second function therefore of the armor is to catch these fragments before they fully penetrate that armor. To this end, many armors also include materials which serve to contain the projectile fragments. In engineering terms, a material chosen for this purpose should have a large strain before failure. Such materials include, but are not limited to: metals; various resins, which may in turn be reinforced by any of several polymers; such as Kevlar™, manufactured by Dupont and SpectraShield™, manufactured by Allied Signal Corp.; or Kevlar™ and SpectraShield™ bullet-resistant fabrics without being resin bonded. High strength glass fibers may also serve the previously discussed fiber-reinforcing function.

Many armor materials, when struck with a ballistic projectile, tend to dissipate much of the projectile's kinetic energy by ablating small fragments and particles from the body of the armor itself. At the same time that many of the projectile fragments continue substantially on their original trajectory, another portion of the bullet fragments, as well as a portion of the ablated armor fragments, are reflected back by the hardened component of the armor in a direction substantially opposite to the bullet's original trajectory. This shower of "splashback" fragments can be enhanced by confining the hard material in such a way that fragments ablated from the surface of the armor have no other path of travel other than substantially opposite to the bullet's original trajectory. Ablation, as used in this invention, is defined in the following paragraph. The action of these fragments serves to further erode the bullet into small fragments. Many of these splashback particles and fragments have a velocity component as high as one half of the projectile's velocity at impact. The splashback comprising bullet fragments and ablated armor fragments forms a relatively high-velocity spray of material which serves as one reactive method for incapacitating an assailant.

Ablation, as used herein, describes the complex erosive process, which is not necessarily or predominately a thermal process, that occurs when a high velocity projectile impacts an armor system. Ablation involves the fragmentation of at least a portion of the armor, and may refer to the fragmentation of the projectile as well. The energy the projectile expends in ablating the armor diffuses the projectile's directed energy, thus reducing or eliminating the projectile's ability to fully penetrate the armor.

Several other incapacitating methods or agents are currently available for use in rendering an assailant temporarily incapable of further hostile acts. Examples of such incapacitating agents include, but are not limited to: chemical agents such as: tear gas, Mace™, and pepper spray; electronic shock apparatus; and flash apparatus. The present invention specifically contemplates the incorporation of the such agents and methods to provide additional reactive incapacitation methodologies.

While the reactive ballistic protection device described above is exemplified as an armored clipboard, the principles of the present invention may, with equal facility and utility, be implemented in a variety of articles and devices. These devices include, but are not limited to: attache cases or other hand luggage; umbrellas; skateboards; partitions; and furniture panels. Several of these devices will be subsequently described herein.

U.S. Pat. Nos. 4,153,927; 4,919,037, and 4,442,780 detail the work of others to provide a ballistic protection device incorporated within a clipboard. U.S. Pat. No. 3,762,345 details the efforts of one worker to provide ballistic protection by an armored attache case. None of the cited references teach or disclose an effective method for eliminating or reducing the effectiveness of an assailant's second shot.

An apparatus which combines the ballistic resistance of modern armor technology with the reactive incapacitating feature will not only serve to protect the user from an assailant's first bullet, but will also, at least temporarily, disable such an assailant and prevent his making a potentially more lethal second shot.

DISCLOSURE OF INVENTION

A device as taught by the present invention combines, in a novel manner, a lightweight ballistic armor section to stop a first bullet, with one or more reactive incapacitating devices to reduce or eliminate the danger from a second or subsequent bullet. By operatively combining modern armor with a reactive incapacitating device, the present invention not only alleviates much of the danger of a first shot by an assailant, but also serves to incapacitate such an assailant, at least temporarily, thereby rendering an assailant's second shot either impossible or ineffective.

The present invention provides a user an object which is interposable in the line of fire between the user and an assailant. Such interposition may be dynamic or static. Dynamic interposition is provided by incorporating the principles of the present invention in a portable device which is quickly moved into position to provide shielding. Static interposition is provided by incorporating the principles of the present invention in one or more panels installed in furniture or a building, behind which panel an individual can quickly seek shelter.

Ballistic armor, when combined with everyday objects such as purses, clipboards, umbrellas, notebooks, briefcases and other commonly available articles, can be ready at hand, but is inherently non-threatening to the casual observer. Incorporating armor in everyday devices of this type makes the armor readily available to the user, without requiring him or her to carry items that are not used in the normal course of daily business. Where required, suitable handles would be designed for the specific object used.

Further contemplated by the present invention are devices having armor and disabling apparatus in operative combination, which devices are designed to no other purpose than personal protection. Such overt protective devices such as foldable personal shields and the like, are not covertly carried, but are overtly deployed.

Armor materials suitable for use in the present invention include a wide variety of materials. Materials currently in use to provide lightweight armors with superior resistance to penetration broadly include metals, ceramics, cermets, and polymers. These materials include, but are not limited to, the following examples. Metals include steels, high-strength titanium alloys, cobalt alloys, nickel alloys and aluminum alloys. Ceramics include metallic oxides, carbides, nitrides, and borides. Cermets include combinations of ceramics and metals of the types previously discussed. Polymers include polyesters, aramids, epoxies, polyolefins, polycarbonates and polyamides. Finally, composites include articles formed with at least one of the foregoing polymers used as a resin wherein reinforcing fibers of metals, ceramics, carbon, boron, aramids, polyolefins, or glasses are incorporated therein. Composites are also constructed of metals in a resin matrix, or ceramics in a metal or resin matrix.

Reactive incapacitating devices contemplated for inclusion in the present invention include, but are not limited to, flashbulbs, flash lamps, stinging liquid sprays, irritating or injurious materials and other incapacitating methods and materials well known in the art. Specifically contemplated by the present invention is the use of the previously discussed splashback fragments to incapacitate an assailant. The present invention may be implemented so that the incapacitating feature thereof is actuated automatically upon discharge of a nearby weapon or by a bullet striking the device. Optionally, the incapacitating feature may be manually activated by the user.

Other features of the present invention are disclosed or apparent in the section entitled "Best Mode of Carrying Out the Invention."

BRIEF DESCRIPTION OF THE DRAWINGS

For fuller understanding of the present invention, reference is made to the accompanying drawing in the following detailed description of the Best Mode of Carrying Out the Invention. In the drawing.

BEST MODE OF CARRYING OUT THE INVENTION

Figure 1:
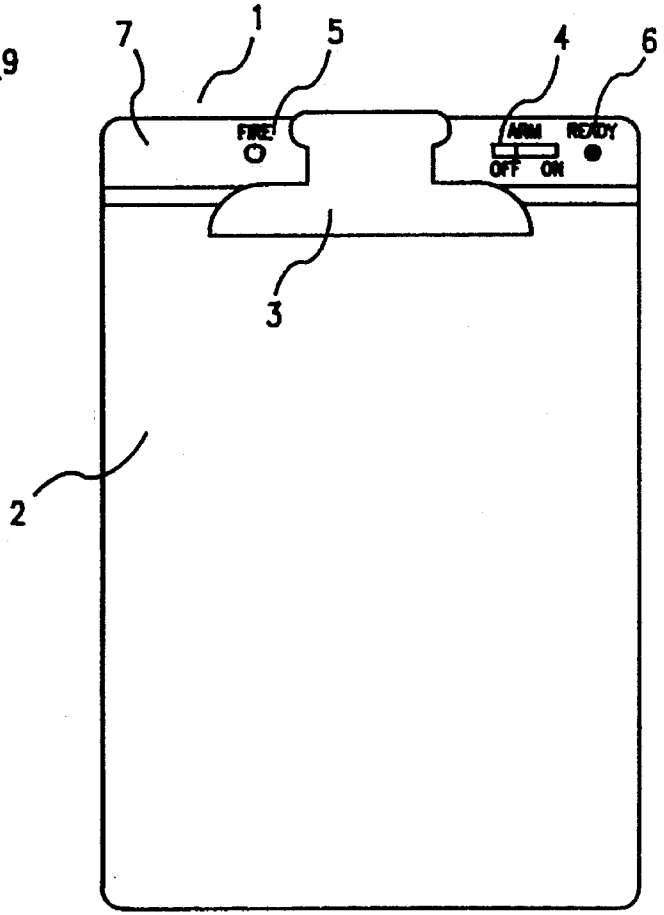
FIG. 1 is a front view of an armored device with reactive disabling feature, in the form of a clipboard.
Figure 2:
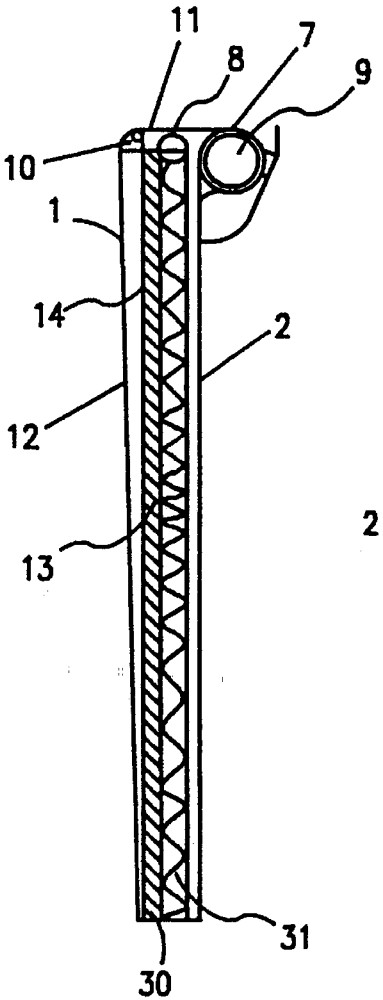
FIG. 2 is a cutaway side view of an armored device with reactive disabling feature in the form of a clipboard.

Referring to FIGS. 1 and 2, one embodiment of the present invention, in the form of a reactive armored clipboard, is detailed. In the preferred embodiment, the present invention comprises an armor panel in operative combination with a reactive incapacitating device in the form of a blinding strobe flash. Clipboard 1 is designed to be carried normally and quickly interposed between the user and an assailant in the event of attack. An assailant's bullet would therefore first impact the back surface of clipboard 1. The back surface of clipboard 1 further comprises a clear lens, 12. The present invention responds to the discharge of the assailant's weapon and reactively fires flash lamp 10. Flash lamp 10, reflected first from reflector 11 then illuminates a reflective surface 14 disposed upon the back surface of armor panel 13 and, through lens 12, temporarily blinds the assailant, enabling the user to seek shelter or to counterattack.

Referring to FIG. 1, clipboard 1 is completely functional as a portable writing platform, and has disposed upon an upper face writing surface 2 and handle 7. Writing surface 2 may be formed of armor panel 13 itself, or as an additional veneer layer superimposed thereon for the sake of appearance. Disposed upon handle 7 is spring-biased clip 3 for receiving and restraining papers and documents between clip 3 and surface 2. Alternatively, handle 7 may be disposed along either side or back of clipboard 1, and clip 3 may be is attached directly to surface 2. Disposed upon handle 7 are arm switch 4, manual fire switch 5 and ready indicator 6.

As shown in FIG. 2, the body of clipboard 1 is formed of an armor panel 13. Any reasonably lightweight armor capable of effectively stopping small arms fire may be implemented in the present invention. In the preferred embodiment, modern technical armors, which generally comprise a multi-layer armor system including a hard surface layer over a catching layer, are used. Additional catching layers may be added behind the first catching layer for added protection where required. Technical ceramics or cermets generally form the hard layer and make up the first armor surface which the bullet impacts. Ceramics contemplated for use in the present invention include but are not limited to: aluminum oxide (alumina), silicon carbide, aluminum nitride, boron carbide, and titanium diboride. Cermets include a technical ceramic such as those previously exemplified compounded with a metal binder such as aluminum, titanium, copper, beryllium or the like.

The catching layer behind the hard layer catches the bullet after it has been fragmented by the hard layer. A catching layer is generally composed of material which exhibits great stretch before failure. Such materials include but are not limited to: special steels; titanium alloys; alloys of nickel and chromium and aluminum; high-strength polymers or other fibers and resins. Polymers useful as catching layers include, but are not limited to: polyolefins, such as SpectraShield™, manufactured by Allied Signal Corp., and aramids, such as Kevlar™, manufactured by Dupont. While not strictly a polymer, high-strength glass fiber-reinforced resins may also serve as the stopping layer. Armor panel 13 in this embodiment consists of a hard layer 30 formed of silicon carbide-aluminum cermet bonded with polysulfide adhesive to a stopping layer 31 formed of Kevlar™—reinforced epoxy resin.

Disposed within handle 7 is battery compartment 9, having a closure for retaining an electrical battery, or other electrical energy storage device, within the compartment and for completing the electrical path to utilize the electrical energy stored therein. Further disposed within handle 7 are circuit board 8, flash lamp 10, and reflector 11. A plurality of flash lamps 10 may be utilized to intensify the incapacitating flash, to spread the flash pattern, or to provide a series of flashes. Circuit board 8, comprising a flash lamp control circuit and responsive to a plurality of electrical switches, controls the arming and firing of flash lamp 10. Arm switch 4 charges circuit board 8 from an energy storage device (not shown) carried within compartment 9, preparatory to use. Fire switch 5 controls the manual functioning of flash lamp 10. Reactive switch 16, disposed upon lens 12, initiates the reactive functioning of flash lamp 10 in response to the discharge of an assailant's weapon.

Figure 3:
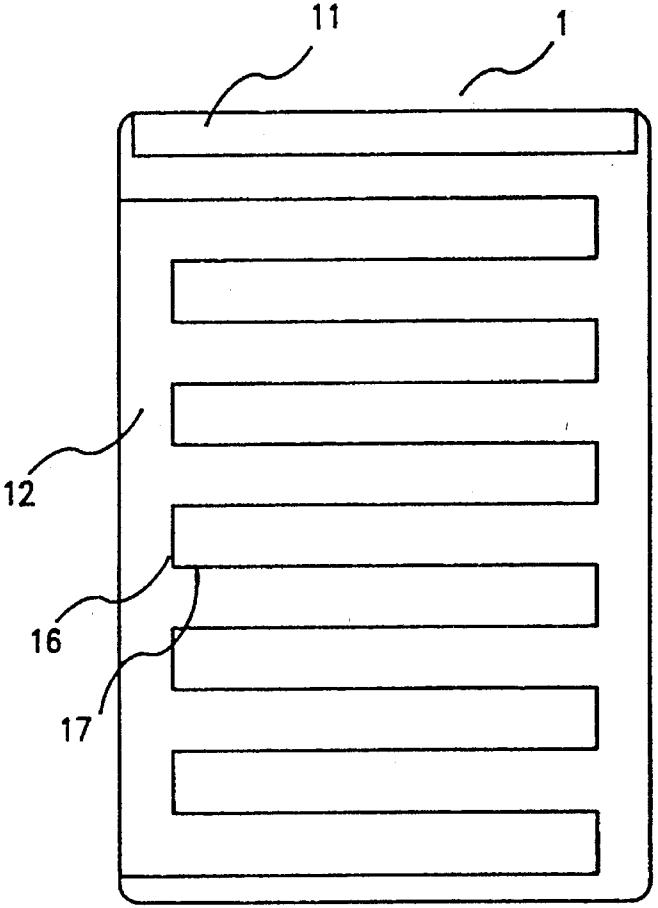
FIG. 3 is a rear view of an armored device with reactive disabling feature in the form of a clipboard.

Referring to FIG. 3, a reactive initiator, or switch 16, implemented as a serpentine electrical breakwire 17, is disposed on or formed within lens 12. The bullet, in penetrating lens 12 severs breakwire 17, and circuit board 8, being configured to sense the open circuit so caused, fires flash lamp 10. Alternatively, reactive switch 16 may be implemented by forming lens 12 with a separate clear and electrically conductive coating on either side of lens 12. In this embodiment the bullet, in passing through the lens, makes momentary contact between the two surfaces, and circuit board 8, being configured to sense the momentary closing of these two surfaces by the bullet, fires flash lamp 10. Other reactive switch mechanisms include: using a microphone to detect the firing of the assailant's weapon; detecting the impact of the bullet by an accelerometer implemented within clipboard 1; or any other switching device well known in the art which is capable of detecting the discharge of an assailant's weapon or the impact of a bullet.

Figure 4:
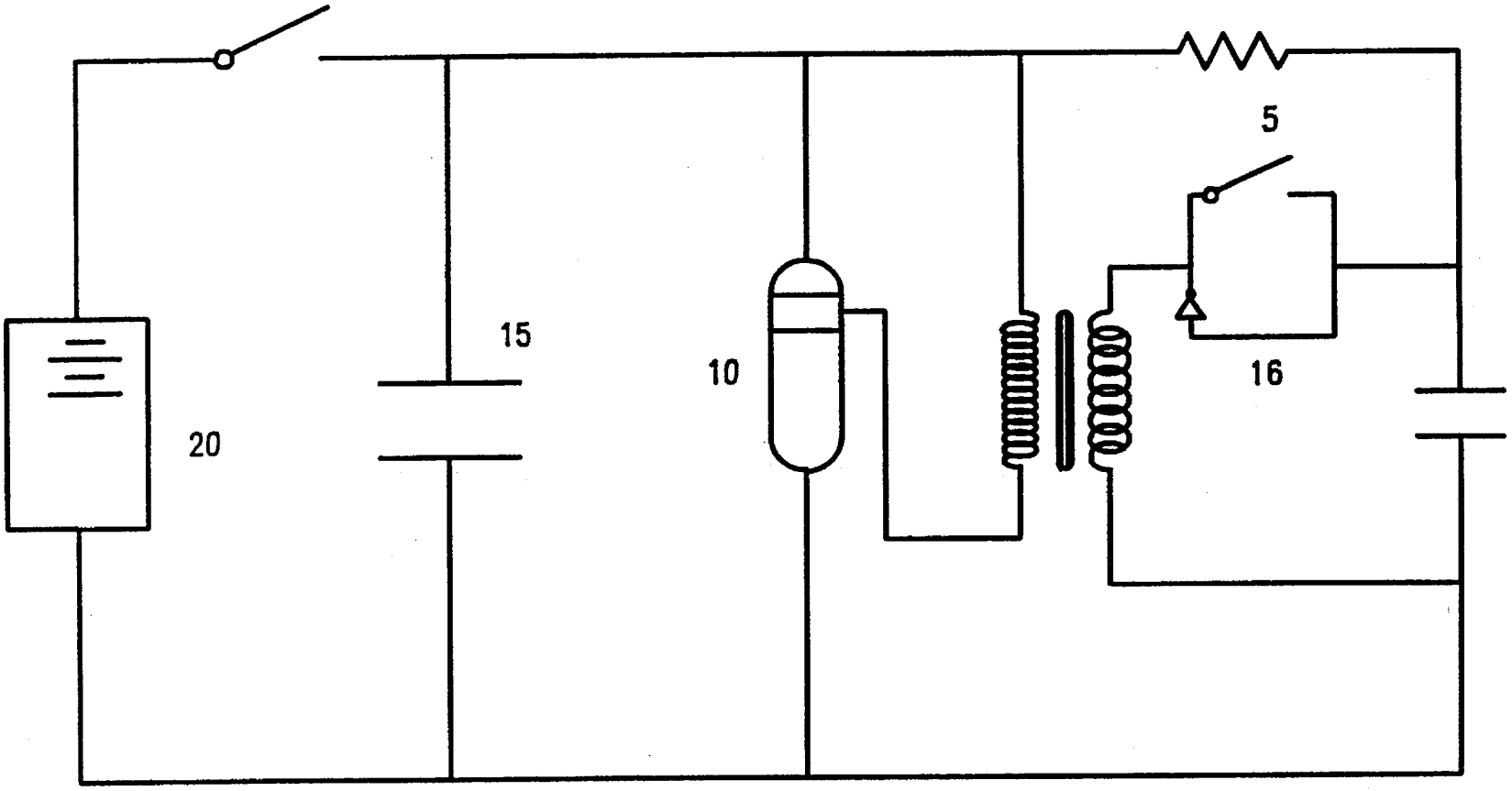
FIG. 4 is an exemplary circuit design for implementing a reactive flash feature.

Once reactive switch 16 is actuated, circuit board 8 directs the electrical energy stored in circuit board 8 to flash lamp 10, temporarily blinding an assailant as previously discussed. By way of illustration, but not limitation, one circuit design for implementing circuit board 8 is presented at FIG. 4. Circuit board 8 directs power from voltage source 20 to charge capacitor 15. Once capacitor 15 is charged, the unit is armed and ready for use. Flash lamp 10 is fired either manually by actuating switch 5 or automatically by switch 16 being actuated, again as previously discussed.

Also shown in FIG. 2 are armor panel 13, reflective surface 14 and lens 12. When flash lamp 10 is activated, its flash is reflected from reflective surface 14 through lens 12 into an assailant's eyes. Lens 12 is preferably formed of clear polycarbonate. Alternatively, any reasonably strong, clear material including, but not limited to styrenes, acrylics, acetates, glasses and the like could implemented with equal facility. Reflective surface 14 may be implemented by applying a wide variety of reflective coatings or films such as metallized Mylar™ to the back surface of panel 13.

An alternative to the xenon strobe flash lamps previously discussed is the use of krypton-filled flash lamps or battery-powered zirconium-wool/oxygen flashbulbs. Utilization of these alternative flash lamps may require minor modification of circuit board 8, as is well known in the art.

By selecting an ablative, frangible armor (including, but not limited to the previously discussed technical ceramics and metallic cermets thereof), the armor itself provides a first reactive incapacitating device. An assailant in close proximity to such a device who fired a bullet which was intercepted by the device, would find himself in a spray pattern of the ablated fragments reflected back from the surface of the armor. These fragments, traveling towards the assailant at approximately one-half the velocity of his bullet, would act much as birdshot in his face, thereby incapacitating him.

Figure 14:
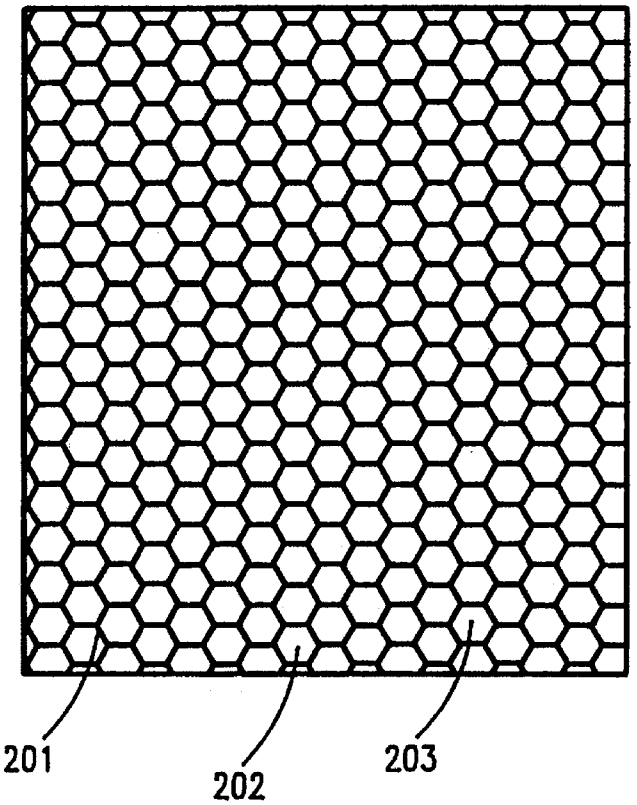
FIG. 14 is a cut-away top view of a built-up composite armor having an integral chemical disabling feature.
Figure 13:
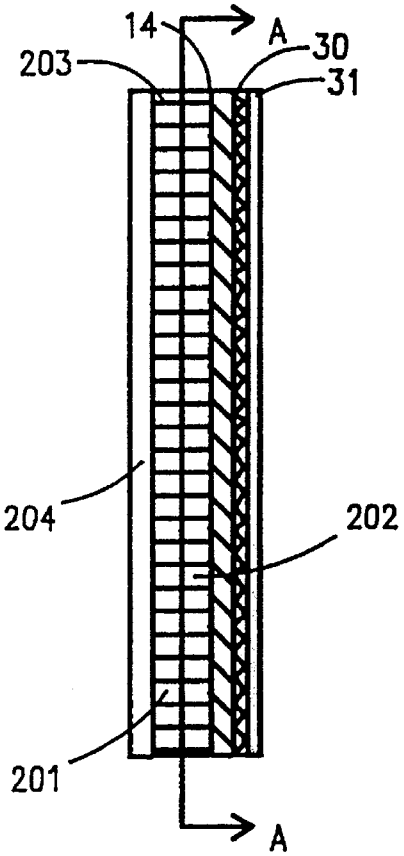
FIG. 13 is a side view of a built-up composite armor having an integral disabling feature.

A further method of reactively incapacitating an assailant involves the use of chemical agents in reactive combination with the armor element of the present invention. By way of illustration but not limitation, these chemical incapacitating agents include Mace™, pepper spray, tear gas, or other non-lethal chemical agents well known in the art. The chemical agent may have mixed therewith any of several marking agents including, but not limited to: dyes, dyestuffs, paints, inks, pigments, ultraviolet marking pigments, or chemical tagging agents well known in the art for marking an assailant for the purposes of identification. The incorporation of chemical agents as an additional reactive incapacitating method is illustrated in FIGS. 13 and 14. According to this embodiment of the present invention, the armor panel is modified to reactively spray a chemical agent towards the threat. To accomplish this aim, armor panel 13 comprising hard layer 30 and catching layer 31 is modified by having a hollow honeycomb panel 201 adhesively bonded to the back surface of hard layer 30. Panel 201 defines a plurality of hollow cells 202. Honeycomb panel 201 is then filled with the chosen chemical agent 203. A substantially impermeable cover 204 is adhesively bonded to the cells of honeycomb panel 201, effectively sealing agent 203 within the cells. One material suitable for forming cover 204 is mild steel sheet.

Honeycomb 201 is formed of a resin-impregnated paper, fiberboard, metallic strip core, or other material well known in the art. One material for use with this implementation is resin-impregnated Nomex™, manufactured by Dupont. Bonding agents contemplated for bonding honeycomb 201 to hard layer 30 and cover 204 to honeycomb 201 include epoxies, cyanoacrylates, polysulfides, as well as other non-permeable, permanent adhesives well known in the art.

An assailant's bullet would first strike and pierce cover 204. As the bullet travels through the chemical agent-filled panel 201, the kinetic energy of the bullet would expel a portion of chemical agent 203 through the bullet's entrance hole and towards the assailant. When the bullet impacts the surface of hard layer 30, the previously discussed splashback may impel an even greater amount of agent towards the assailant both through the original bullet hole, and through new holes created as the splashback erupts through the surface of the cover.

In addition to the previously discussed honeycomb for implementing a reactive chemical agent, the present invention teaches an alternative methodology. Many ceramic armors are inherently porous. Pepper oil, or another chemical incapacitating agent, stored in the pores of a suitably selected porous armor, would have a similar effect on an assailant as the previously discussed chemical filled honeycomb panel. A suitable permanent coating, which is substantially impermeable, such as an epoxy or polyurethane paint, seals the surface of the armor after the agent is stored in the pores thereof.

Figure 6:
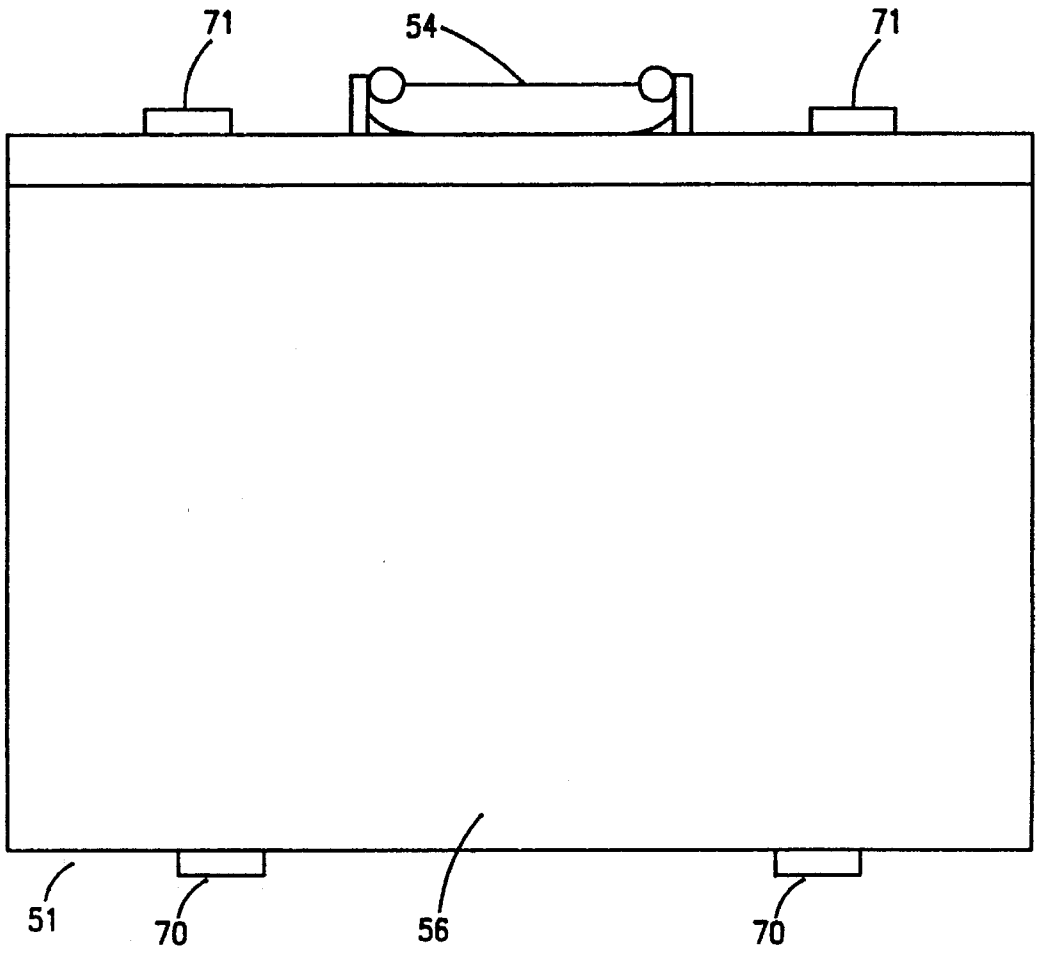
FIG. 6 is a back view of an armored device with reactive disabling feature in the form of an attache case.
Figure 5:
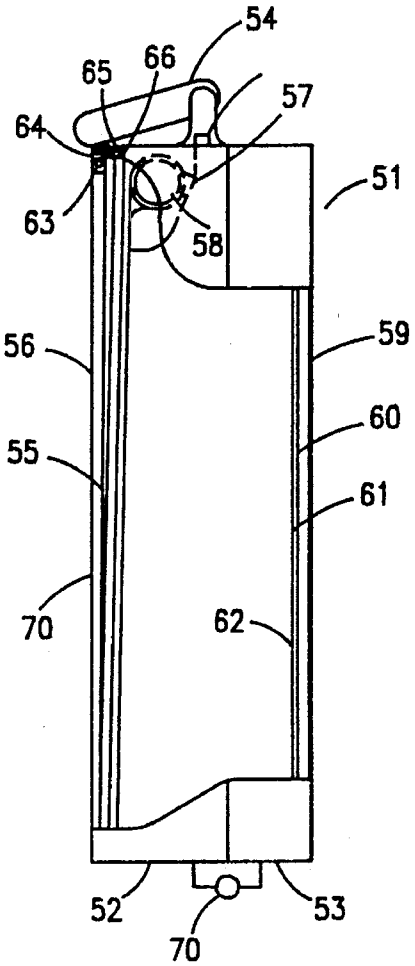
FIG. 5 is a side view of an armored device with reactive disabling feature in the form of an attache case.

A second embodiment of the present invention is formed as an attache case, detailed in FIGS. 5 and 6. Referring to FIG. 5, an armored attache case 51 having a reactive incapacitating feature is detailed. Attache case 51 is composed of body 52, lid 53, handle 54, hinges 70, and latches 71; and in external appearance is substantially similar to other well known hand luggage. In similar manner to the armored clipboard previously discussed, case 51 has disposed within body 52 a disabling flash device. In this embodiment, battery compartment 58 is disposed in housing 57 further disposed on an interior surface of body 52. Housing 57 further contains flash lamp 63, and circuit board 65. Functionality of the several operative elements of this embodiment are substantially the same as those of the clipboard previously discussed.

Reflector 64 directs the flash emitted from bulb 63 downward. Reflector 55 directs the flash outward through lens 56 into an assailant's eyes.

In this embodiment, the armor is disposed about one surface of lid 53. This surface is composed of outer cover 59, armor panel 60, padding 61 and inner cover 62. In the preferred embodiment, armor panel 60 is composed of silicon carbide tiles bonded with polysulfide adhesive to a high-strength steel substrate. Alternative armors could include titanium boride, aluminum oxide, boron carbide, aluminum nitride, hardened steel, titanium alloy, cobalt alloy, nickel alloy, aluminum alloy, cermets, nitride and oxide ceramics, aramid (e.g.: Kevlar™), Spectra-Shield™, and fiber reinforced plastics, elastomers or combinations of the foregoing. Suitable reinforcing fibers include glass, aramid (Kevlar™), and carbon. Furthermore, one or more of outer covering 59, padding 61 or inner cover 62 may be formed of Kevlar™, Spectra-Shield™, or other armored fabric for enhanced ballistic protection.

Another incapacitating device suitable for inclusion in this embodiment is the chemical agent-filled honeycomb panel previously discussed. Referring again to FIGS. 12 and 13, this device is detailed. The side of the case normally carried outward 70 covers a honeycomb panel 201 which is filled with an incapacitating agent 203. Honeycomb panel 201 is sealed with cover 204, which is sufficiently sturdy to withstand normal daily use without being broken or penetrated. Honeycomb panel 201 is backed by armor panel 13 which serves to resist penetration, and causes the energy of the projectile to be dissipated among several of the honeycomb cells 202 of panel 201 so that they will burst outwardly. Agent 203 will then splash or squirt back in the direction of the assailant, impelled by the energy of the projectile imparted to the honeycomb panel.

In this embodiment, armor panel 13 composed of an armor as described elsewhere herein, bonded to an rear surface 61 of Kevlar™ which may also be the interior panel of the briefcase. Bonding of surface 61 to material 60 may be accomplished with various epoxies, polysulfides, cyanoacrylates or other adhesives well known in the art. Interior cover 62 covers surface 61 to visually blend with the interior decor of the briefcase. Panel 62 further serves to conceal the protective device from unwanted examination.

FIG. 6 details the external appearance of one surface of case 51, showing lens 56.

Figure 7:
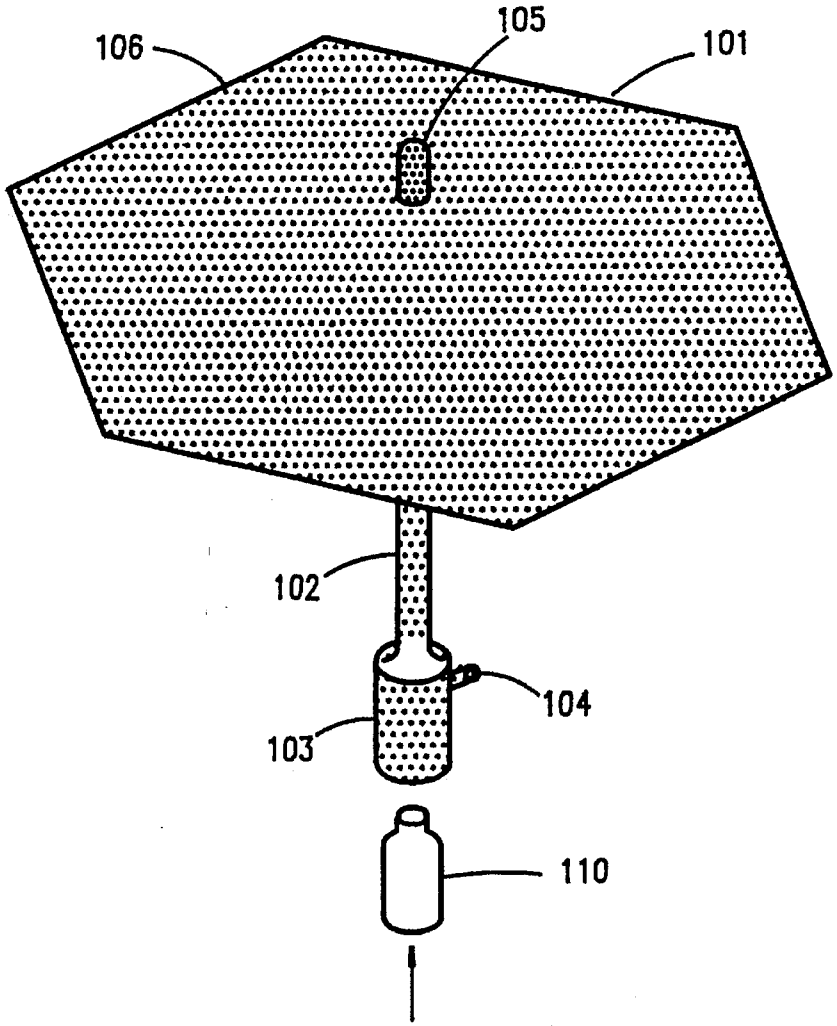
FIG. 7 is a perspective drawing of an armored device with reactive disabling feature in the form of an umbrella.
Figure 8:
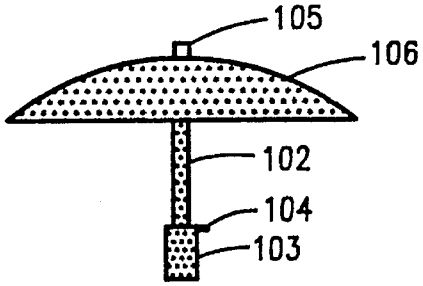
FIG. 8 is a side view of an armored device with reactive disabling feature in the form of an umbrella.
Figure 9:
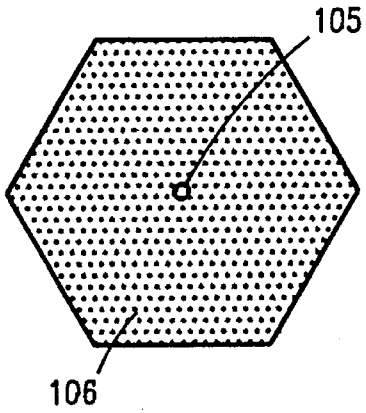
FIG. 9 is a top view of an armored device with reactive disabling feature in the form of an umbrella.

Still another embodiment of the present invention is presented in FIGS. 7 8, and 9. This embodiment is formed as an umbrella 101 as shown in FIG. 7. Umbrella 101 is substantially similar in external appearance to other well-known bumbershoots. In this embodiment, canopy 106 is retractably deployable on ribs (not shown) which are foldably carried on hollow shaft 102 as is well known in the art. Shaft 102 terminates in handle 103. In this embodiment, canopy 106 is formed of Kevlar™, Spectra-Shield™, or other armored fabric for ballistic protection. A chemical incapacitating agent, such as Mace™, is contained within handle 103. The chemical agent may be carried in a disposable or refillable cartridge 110, carried within handle 103. At least one O-ring seal precludes leakage of the incapacitating agent from the handle. A valve or switch 104 releases the incapacitating agent from the agent-filled cylinder contained in handle 103. When valve 104 is actuated, incapacitating agent is forced from the cylinder through handle 103 and shaft 102 through nozzle 105. Upon being attacked, a user can point umbrella 101 at the assailant, deflecting a bullet with canopy 106 while depressing valve 104 which sprays incapacitating agent stored in handle 103 into the assailant's eyes. This canister dispenses it's contents down the shaft of the umbrella and out in the direction of the assailant. The canister may be expendable or refillable.

Figure 10:
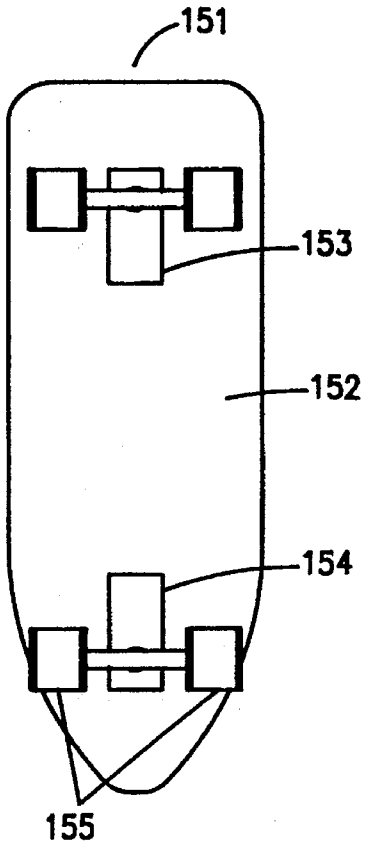
FIG. 10 is a bottom view of an armored device with reactive disabling feature in the form of a skateboard.
Figure 11:
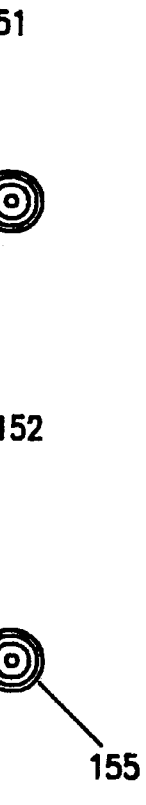
FIG. 11 is a side view of an armored device with reactive disabling feature in the form of a skateboard.
Figure 12:
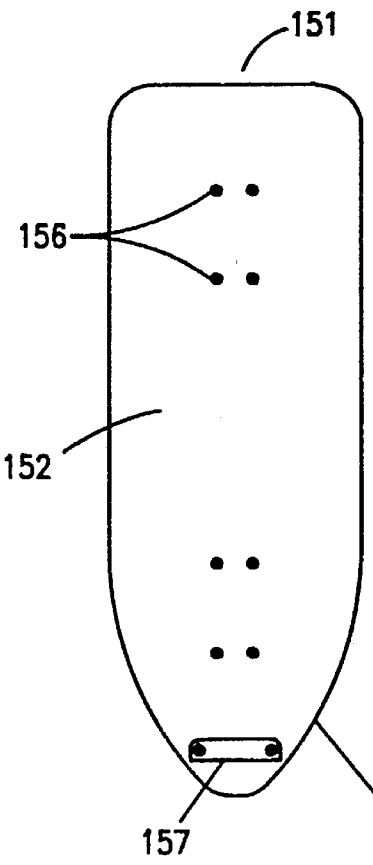
FIG. 12 is a top view of an armored device with reactive disabling feature in the form of a skateboard.

Another embodiment of the present invention is detailed in FIGS. 10–12. In this embodiment, the armor panel is formed on a skateboard 151 for the protection of children. As shown in FIG. 10, skateboard 151 comprises platform 152, which further comprises an armor panel. Attached to platform 152 are at least one truck 154, having rollably mounted thereon at least one wheel 155. Truck 154 is attached to board 152 by machine screws 156. Also attached to board 152 is handle 157.

Yet another embodiment incorporating the principles of the present invention teaches the incorporation of the reactive armor of the present invention into furniture for protecting persons engaged in business, banking and so forth. Incorporating the reactive armor of the present invention, as shown in FIGS. 13 and 14 into such furniture elements as counter and desk panels, including tops and fronts would provide protective surfaces for store clerks and bank tellers to shelter behind during a robbery. An outer surface of this embodiment matches the motif or decor of the business establishment or other furniture components. Examples of such panel materials include, but are not limited to: wood; wood veneered hardboard, plywood and the like; Formica™, Nevamar™, or other high pressure laminates; and other furniture surfaces well known to those skilled in the art.

The present invention has been particularly shown and described with respect to certain preferred embodiments and features thereof. However, it should be readily apparent to those of ordinary skill in the art, that various changes and modifications in form and detail may be made without departing from the spirit and scope of the invention, as set forth in the appended claims. Most particularly, it will be readily apparent to those skilled in the art that variations in armor type, incapacitating methodology, and reactive activation, not discussed herein may be employed without departing from the invention as disclosed herein.

What we claim is:

1. A ballistic protection device, interposable between a user and an assailant, said device comprising in operative combination:

an armor panel for deflecting a bullet fired by said assailant;

a reactive initiator disposed on said armor panel, for detecting at least one of the impact of said bullet and the discharge of said assailant's firearm; and an incapacitating flash device further disposed upon said armor panel and in operative combination with said reactive initiator, said flash device including at least one flash lamp, an electrical energy storage device, and a flash lamp control circuit.

2. The method of precluding injury to a user from gunshot by an assailant, said method comprising the steps of:

deflecting, with an armor panel, a bullet fired by said assailant;

detecting, with a reactive initiator disposed on said armor panel, at least one of the impact of said bullet and the discharge of said assailant's firearm; and responsive to said detecting step, incapacitating said assailant with a flash device further disposed upon said armor panel, said flash device including at least one flash lamp, an electrical energy storage device, and a flash lamp control circuit including an arming switch.

3. An armored clipboard, interposable between a user and an assailant, for deflecting a bullet fired by said assailant and for incapacitating said assailant, said clipboard comprising in operative combination:

an armor panel having front and back surfaces;

a reactive initiator disposed on said armor panel, for detecting at least one of the impact of said bullet and the discharge of said assailant's firearm; and an electrically actuated flash device further disposed upon said armor panel and including at least one flash lamp, an electrical energy storage device, and a flash lamp control circuit including an arming switch, said flash lamp, when fired in response to said reactive initiator, incapacitating said assailant;

a writing surface disposed upon said front surface of said armor panel; and a clip, further disposed upon said front surface of said armor panel, for removably receiving and retaining papers and documents on said writing surface.

4. The armored clipboard of claim 3 said armor panel is formed of at least one of the group consisting of: metals, alloys, ceramics, glasses, cermets, polymers, polyesters, aramids, polyolefins, and resins.

5. The armored clipboard of claim 3 wherein said reactive initiator further comprises a serpentine breakwire disposed upon a clear lens disposed about said back surface of said armor panel.

6. The armored clipboard of claim 5 wherein said breakwire is a serpentine breakwire.

7. The armored clipboard of claim 3 wherein said reactive initiator further comprises a make screen including a clear lens disposed about said back surface of said armor panel, said lens having front and back surfaces, each of said front and back surfaces of said lens having an electrically conductive coating applied thereto.

8. The armored clipboard of claim 3 further comprising a manual switch in operative combination with said flash lamp control circuit for manually initiating said incapacitating device.

9. A ballistic protection device, interposable between a user and an assailant, said device comprising in operative combination:

an armor panel for deflecting a bullet fired by said assailant, said armor panel formed of at least one of the group consisting of: metals, alloys, ceramics, glasses, cermets, polymers, polyesters, aramids, polyolefins, and resins;

a reactive initiator, disposed on said armor panel, for detecting at least one of the impact of said bullet and the discharge of said assailant's firearm; and an incapacitating strobe flash further disposed upon said armor panel and automatically actuated responsive to said reactive initiator, said strobe flash including at least one flash lamp, an electrical energy storage device, and a flash lamp control circuit.

10. The ballistic protection device of claim 9 wherein said reactive initiator further comprises a breakwire further disposed on said armor panel.

11. The ballistic protection device of claim 9 wherein said reactive initiator further comprises a make screen further disposed on said armor panel.

12. A ballistic protection device, interposable between a user and an assailant, said device comprising in operative combination:

an armor panel for deflecting a bullet fired by said assailant, said armor panel formed of at least one of the group consisting of: metals, alloys, ceramics, glasses, cermets, polymers, polyesters, aramids, polyolefins, and resins and having front and back surfaces;

a reactive initiator, disposed on said armor panel, for detecting at least one of the impact of said bullet and the discharge of said assailant's firearm; and an electrically actuated flash device disposed upon said back surface of said armor panel and including at least one flash lamp, an electrical energy storage device, and a flash lamp control circuit including an arming switch, said flash lamp, when fired in response to said reactive initiator, for incapacitating said assailant.

13. The ballistic protection device of claim 12 implemented on at least one of the devices in the group consisting of: clipboard; briefcase; purse, umbrella, skateboards and furniture panel.

14. An armored clipboard, interposable between a user and an assailant, for deflecting a bullet fired by said assailant and for incapacitating said assailant, said clipboard comprising in operative combination:

an armor panel formed of a hard layer defining a back surface of said armor panel and formed of at least one ceramic tile, said tile bonded with polysulfide adhesive to a catching layer, said catching layer formed of a fiber-reinforced resin composite structure, and substantially defining a front surface of said armor panel;

a handle assembly disposed upon said armor panel for carrying and holding said clipboard;

a writing surface disposed upon said front surface of said armor panel;

a spring clip, further disposed upon said front surface of said armor panel, for removably receiving and retaining papers and documents on said writing surface;

a reflective surface disposed upon said back surface of said armor panel;

a clear lens further disposed upon said back surface and substantially covering said reflective surface;

a strobe flash disposed within said handle assembly and including at least one flash lamp, an electrical energy storage device, and a flash lamp control circuit including an arming switch, said flash lamp, when fired, illuminating said reflective surface; and a serpentine breakwire disposed upon said clear lens and forming a reactive switch in electrical contact with said flash lamp control circuit for detecting the impact of said bullet and causing said flash lamp control circuit to fire said flash lamp, said flash lamp for illuminating said reflective surface and thereby incapacitating said assailant.

* * * * *